US007832120B2

(12) United States Patent
Jung

(10) Patent No.: US 7,832,120 B2
(45) Date of Patent: Nov. 16, 2010

(54) ANTI-SLIP FOOTWEAR

(76) Inventor: Man-Young Jung, 2750 E. Washington Blvd. Ste. 150, Pasadena, CA (US) 91107-6201

( * ) Notice: Subject to any disclaimer, the term of this patent is extended or adjusted under 35 U.S.C. 154(b) by 694 days.

(21) Appl. No.: 11/973,449

(22) Filed: Oct. 8, 2007

(65) Prior Publication Data

US 2009/0090031 A1 Apr. 9, 2009

(51) Int. Cl.
*A43B 23/28* (2006.01)

(52) U.S. Cl. ..... 36/59 R; 36/59 C

(58) Field of Classification Search ..... 36/59 R, 36/59 C, 8.1
See application file for complete search history.

(56) References Cited

U.S. PATENT DOCUMENTS 3,043,025 A * 7/1962 Semon ..... 36/59 R
3,237,322 A * 3/1966 Santore ..... 36/59 C
3,555,697 A * 1/1971 Dassler ..... 36/129
4,007,549 A * 2/1977 Moore ..... 36/59 C
4,118,878 A * 10/1978 Semon ..... 36/59 C
4,356,643 A * 11/1982 Kester et al. ..... 36/59 C
5,371,958 A * 12/1994 Brosseau ..... 36/8.1
5,473,788 A * 12/1995 Aragona ..... 15/104.92
7,191,549 B2 * 3/2007 Koo ..... 36/59 C
2001/0010127 A1 * 8/2001 Polegato Moretti ..... 36/3 B
2004/0163282 A1 * 8/2004 Pan ..... 36/59 R
2007/0017124 A1 * 1/2007 Koo et al. ..... 36/59 R

* cited by examiner

*Primary Examiner*—Marie Patterson
(74) *Attorney, Agent, or Firm*—Clement Cheng

(57) ABSTRACT

A moisture repellant tread is provided for a positive displacement of moisture to secure the traction in the bottom of a shoe. The tread comprises a base plate and multiple short bundles of absorbent fibers. The base plate has a top surface locally bonded to the outsole with a lateral clearance between the base plate and outsole about the bonded areas, a bottom surface for contacting a floor and multiple closely arranged recesses open to the bottom surface and communicating through smaller openings formed at the top surfaces concentrically of the recesses. The fiber bundles are partially implanted in the recesses for displacing water absorbed from the floor upon contact through the openings at the top surfaces to the lateral clearance whereby the tread secures an increased traction as a wearer steps on the tread through the shoe even on a film of moisture.

20 Claims, 5 Drawing Sheets

ANTI-SLIP FOOTWEAR

BACKGROUND OF THE INVENTION

A. Field of the Invention

The present invention relates to footwear. More particularly, the present invention relates to moisture repelling shoes for preventing an injurious slippage and a tread attachment with moisture repellant effect for transforming common footwear into a slip-resistant foot protection.

B. Description of the Prior Art

The negative phenomenon of hydroplaning originally describes the unfortunate incidents in driving in rain or through a wet road where the footing of a vehicle, i.e. tires fail to grip the ground losing the decisive traction for keeping the safe travel of the vehicle and its occupants. The similar incidents are experienced by common walking individuals in the daily lives at the comfort of homes as well as busy work locations. There are many reports of personal injuries or even unexpected deaths from falls on surrounding hard surfaces stemming from normal shoes or slippers unfortunately stepped on an unsuspected wetted spot.

In order to counter this problem, there have been continuous developments of footwear tread designs for increased traction or grip on the floor. Most footwear comprises an outsole that is in direct contact with the floor and is made of elastic but durable materials such as natural rubber or a synthetic imitation in layers especially at the heel of the sole area for durability and traction. For somewhat extreme traction in athletic shoes, spikes are embedded in the outsole to grip the ground during the athletic event. Usually, gentler ridge designs are incorporated into the outsole bottom of everyday shoes in the hopes to handle universal floor surfaces people encounter daily. However, when the shoes wear out and then caught in a slippery situation, the wearer does very likely fall on the ground such as a glossy bathroom floor where moisture is often present to attribute to high slippage rate. Using improved plastic materials in soles for indoors work or leisure shoes donned in and out of bathrooms and outdoors activity shoes for pools and streams had their own limitations.

Therefore, it is in a dire need to provide so simple safety solution to prevent moisture slides of footwear soles that most household or work shoe types donned close to wet environment can be transformed immediately into slip-resistant foot protection.

In view of the foregoing, the primary object of the present invention is to provide moisture repellant shoes using wearer's own walk load to displace moisture.

Another embodiment of the present invention of the present invention is to provide a tread attachment for repelling moisture to transform common footwear into a slip-resistant shoe.

Yet another embodiment of the present invention is to provide a practically durable and economically attractive yet aesthetically concealed attachment to any known designs of footwear so that the attachment can be either integrated into the existing shoe manufacturing process or individually affixed to shoes in use by the wearers who want to modify common shoes to be slip-proof.

SUMMARY OF THE INVENTION

According to the present invention, moisture repellant slip resistance shoes comprises a top section for enclosing at least a part of the instep of a foot and a sole section attached to the top section for supporting the sole of the foot. The sole section has an outsole with traction surfaces facing a floor. Each of the shoes also has one or more flexible suction pads affixed to bottom surfaces of the sole section, The suction pads have a plurality of small absorbent elements partially planted in the suction pad to contact moisture on the floor and perforations formed through the suction pad for channeling the moisture absorbed by the absorbent elements laterally in response to downward pressures as a wearer walks to have the suction pads maintain a positive grip on the floor as they eliminate a slippery moisture layer between the floor and the shoes. The absorbent elements are fibers made of short cross cuts of cotton strands. Alternatively, they may be synthetic fibers or a mixture of cotton strands and synthetic fibers.

In one embodiment, the absorbent elements are bundled into short columns with free cut ends. They may be made into looped-ends by folding a length of strands of fibers into U-shapes. Multiple lateral channels are formed in the suction pads in communication with the perforations for channeling moisture laterally.

In another embodiment of the present invention, a moisture repellant tread for attachment to an outsole of a shoe comprises a base plate having a top surface locally bonded to the outsole with a lateral clearance between the base plate and outsole about the bonded areas, a bottom surface for contacting a floor and multiple closely arranged recesses open to the bottom surface and communicating through smaller openings formed at the top surfaces concentrically of the recesses; and multiple short bundles of absorbent fibers partially implanted in the recesses for displacing water absorbed from the floor upon contact through the openings at the top surfaces to the lateral clearance whereby the tread secures an increased traction as a wearer steps on the tread through the shoe even on a film of moisture.

The present invention provides a moisture repellant outsole for use with a shoe including a top section for enclosing at least a part of the instep of a foot, the outsole comprising traction surfaces facing a floor, a plurality of small absorbent elements partially planted in the traction surfaces to contact moisture on the floor and perforations formed through the traction surfaces for channeling the moisture absorbed by the absorbent elements laterally in response to downward pressures as the wearer walks to have the traction surfaces maintain a dynamic non-slipping grip on the floor, whereby eliminating an injurious moisture layer between the floor and the shoe.

Embodiments of the invention will now be described by way of example with reference to the accompanying drawings.

BRIEF DESCRIPTION OF THE DRAWINGS

Similar reference numbers denote corresponding features throughout the attached drawings.

DETAILED DESCRIPTION OF THE PREFERRED EMBODIMENT

The present invention concerns improvements in shoe soles, treads, and shoes made using the wet-repellent feature of the improved soles.

Figure 1:
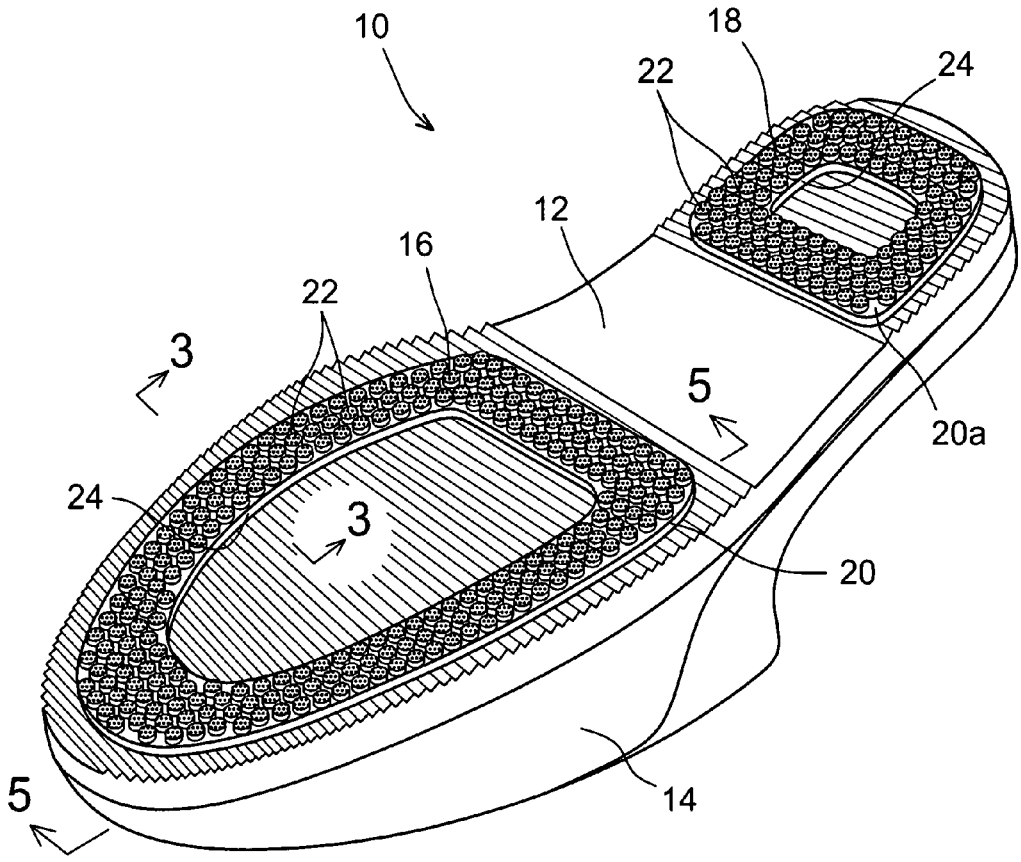
FIG. 1 is a representative perspective view of a shoe with a wet-repellent sole according to the present invention.

With reference to FIG. 1, a shoe 10 of the present invention is illustrated in the form of a conventional slipper including a relatively flat sole 12 made of a flexible and durable material such as natural rubber or a synthetic material to contact with the ground directly and an upper 14 of soft felt, terrycloth or soft leather for holding the shoe 10 onto the foot. In the simple footwear form of slipper, upper 14 may have no heel so the foot can be slipped into the shoe 10 although the wet-repellent structure of the present invention can be universally applied to any typical closed footwear, such as boots, sneakers and most men's shoes with a more complex upper in order to prevent the wearer from slipping on floors. Specifically, a wet-repellent sole tread 16 of the present invention may be attached to shoes and boots that are generally made of canvas, plastic, rubber, or leather, and often have thick soles and improve those shoes to adapt to various wet surfaces around pools, bathrooms, or other damp work environments.

Tread 16 may be in one piece shaped to generally conform to the bottoms of shoes or in two pieces including a separate heel tread 18. Treads 16, 18 comprise flexible base plates 20 and 20*a* and thick transplants of short bundles of absorbent fibers 22, respectively. Either base plate 20 or 20*a* may be solid or has a void 24 in the center because the collective absorbency of the concentrated fiber bundles 22 provides a great displacement of water upon contact with a wet surface as the wearer walks across there.

The tread 16 may be made and attached to shoe sole 12 using conventional methods known in the industry including stitching, gluing, molding and vulcanization by converting uncured material of plate 20 into a stable compound by heat and pressure. When the material in the mold cools, the sole-upper bonding will become permanent.

Figure 2:
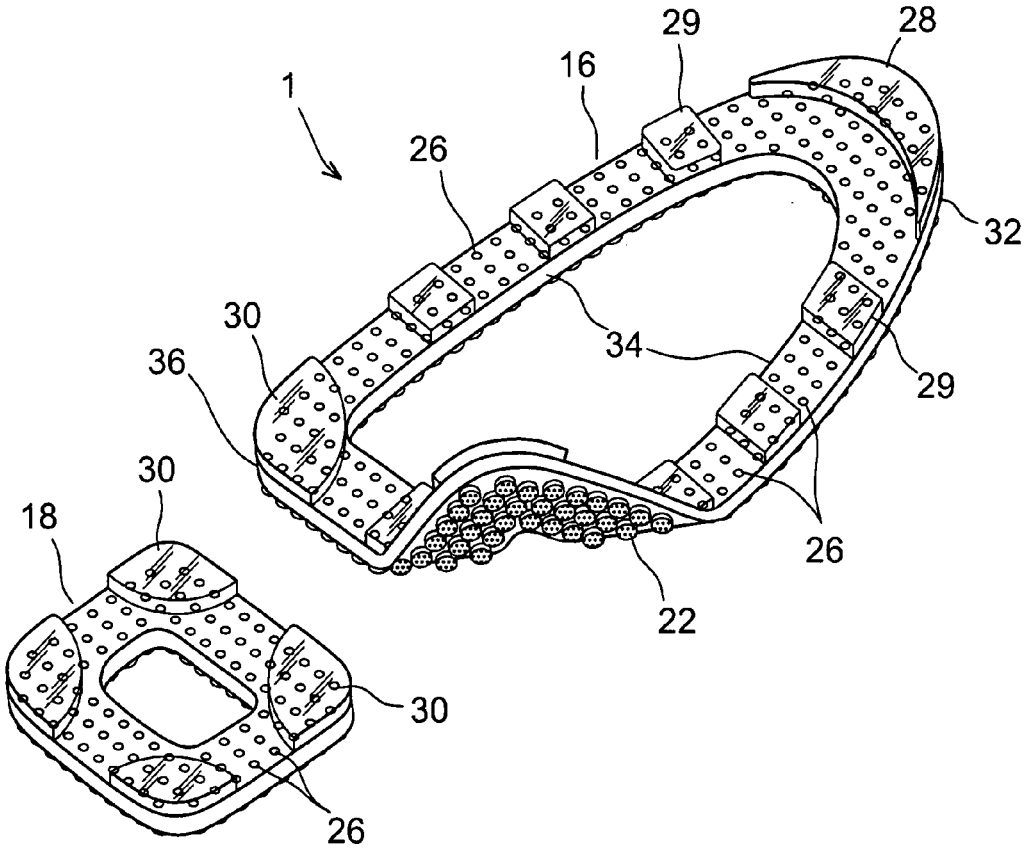
FIG. 2 is a perspective view of a wet-repellent sole attachment according to a first embodiment of the present invention.

FIG. 2 specifically shows a first embodiment of a sole tread 1 of the present invention in a perspective view from the top. Sole tread 1 is adapted to be attached by a wearer to the underside of an existing shoe, which has a shaped tread 26 as exemplified in FIG. 1 but is insufficient to prevent the wearer from slipping at the presence of floor water. Tread 1 in the drawing is partially flexed to show fiber bundles 22 on the underside for contacting the floor safely after it is fixed to the shoe 10. Sole tread 1 provides just enough traction on a surface whether it is dry or wet without compromising the natural walking postures of the wearer or aesthetical value of the general conventional portion of the shoe 10 due to its thin and light structure only using the similar materials used for sole 12 and very light strands of fibers 22. Tread attachment 1 has larger sole section 16 and smaller heel section 18 that can be formed either integrally or separately and are provided with multiple thru holes 26 formed concentrically with fiber bundles 22 for channeling water as will be described below.

Since the sole tread 1 is designed for a custom attachment to the existing shoe sole along the top surfaces of treads 16, 18 there are thick elastic patches 28-30 with a permanent adhesive bonding on both sides shaped to cover discrete areas of tread surfaces. Bonding patch 28 may be in the form of a crescent positioned at a toe area 32 and a number of rectangular patches 29 may be attached along the longitudinal side areas 34 spanning approximately the width of the side area 34. At the rear of tread 16, angled patches 30 may cover the rear corner areas of tread 16. Extra angled patches 30 may be applied to rectangular heel tread 18 at its four corners. Particular shapes and areas of patches 28-30 may be adjusted to fit different tread shapes as long as they help raise treads 16, 18 from the shoe sole 12 while bonding the treads 16, 18 and sole 12 tightly together. Patches 28-30 have the strong enough bonding capability to resist water permeations. Therefore, once attached the sole 12 and treads 16, 18 provide a clearance through which many exposed thru holes 26 can breath to displace water properly.

A non-stick plastic sheet (not shown) may cover the overall adhesive top surfaces of patches 28-30 until the end user of the tread attachment 1 removes it.

Figure 3:
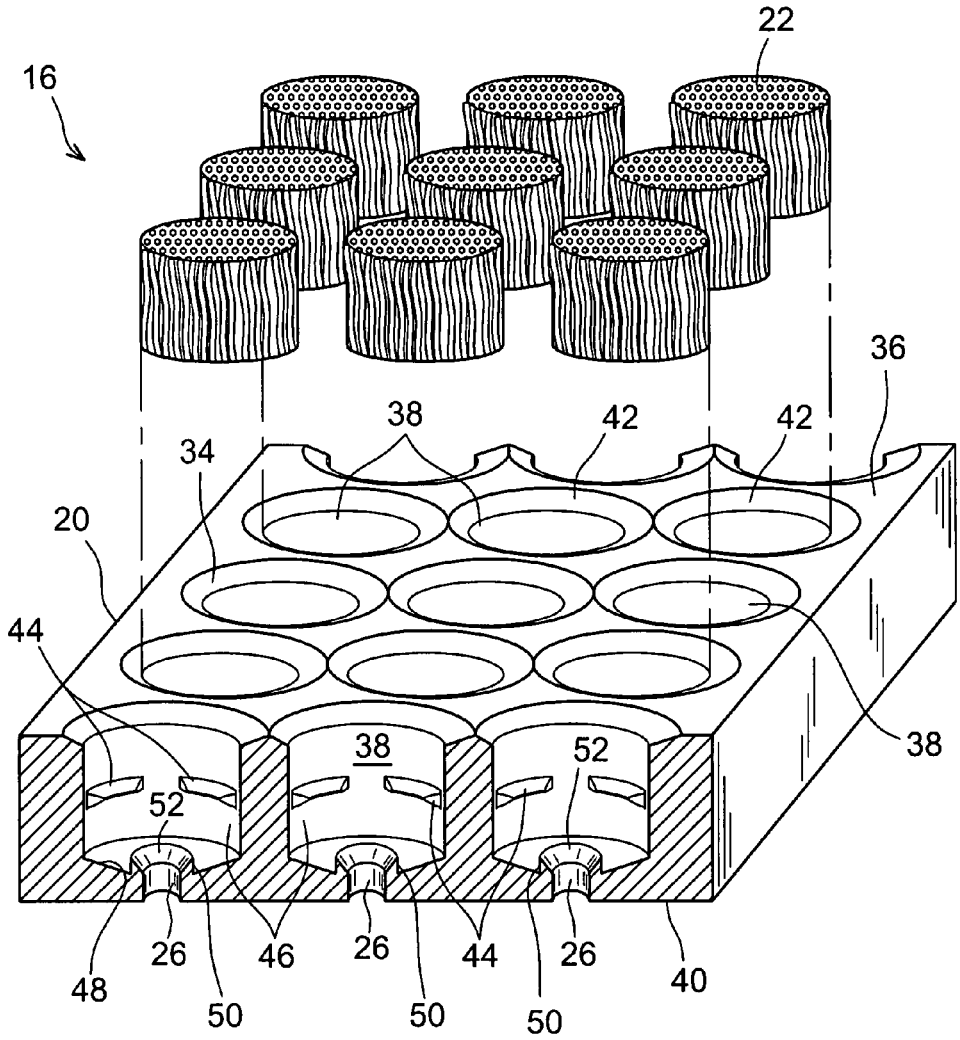
FIG. 3 is a perspective sectional view of the sole attachment of FIG. 2 taken along line 3-3 of FIG. 1 showing fiber blocks in an exploded view.

Referring to FIG. 3 showing the bottom of side area 34 in cross section, the fiber bundles 22 may be a concentrated group of evenly cut cotton yarns used frequently in making floor mops. Fiber bundles 22 may be made of pure cotton or synthetic fibers like rayon or mixture of the two, which may be stranded into a thick yarn having a diameter of about ⅕ of an inch. Cotton fibers are economical and provide high water absorption and retention for effective floor drying. Each fiber bundle 22 may be cut straight latitudinally to provide free ends protruding from bottom surface 34 although they may be cut obliquely to provide a wider absorbing surface. Alternatively, ends of fiber bundles 22 may be formed into loops by folding longer strands of fibers 22 into U-shapes and fastening the two ends in the adjacent recesses.

In manufacture, the continuous cotton yarns may be threaded through a template with holes exactly aligned with the thru holes 26 so that they may be cut all at once to a short length for the fiber bundles 22 to protrude slightly over the bottom surface 36 of base plate 20 after they are planted to base plate 20. In order to hold the fiber bundles 22 firmly, multiple recesses 38 are formed throughout bottom surface 36 of base plate 20. Each recess 34 may be circular and extends close to a top surface 40 that will face the sole 12 positioned above. Recess 34 has a beveled edge 42 at its entrance to allow an easy entrance of the respective fiber bundle 22 and constriction ridges 44 for gripping side areas of the introduced bundle 22 to centrally tighten the fibers in the recess 38 with a firm hold. To keep the plantation of fiber bundles 22 permanent, a bonding material in a liquid form may be applied to inner walls 46 of recesses 38. Taking advantage of the adhesive fluidity and gravity, the bonding process can be done swiftly by generally applying a measured amount of the adhesive gently over the whole bottom surface 36 of base plate 20 with its orientation inverted as depicted in FIG. 3. The adhesive will naturally flow down over the beveled edges 42 to inner walls 46. In addition, thru holes 26 are positioned concentrically of round recesses 38, respectively so that the holes 26 are in full communication with the latter.

Figure 4:
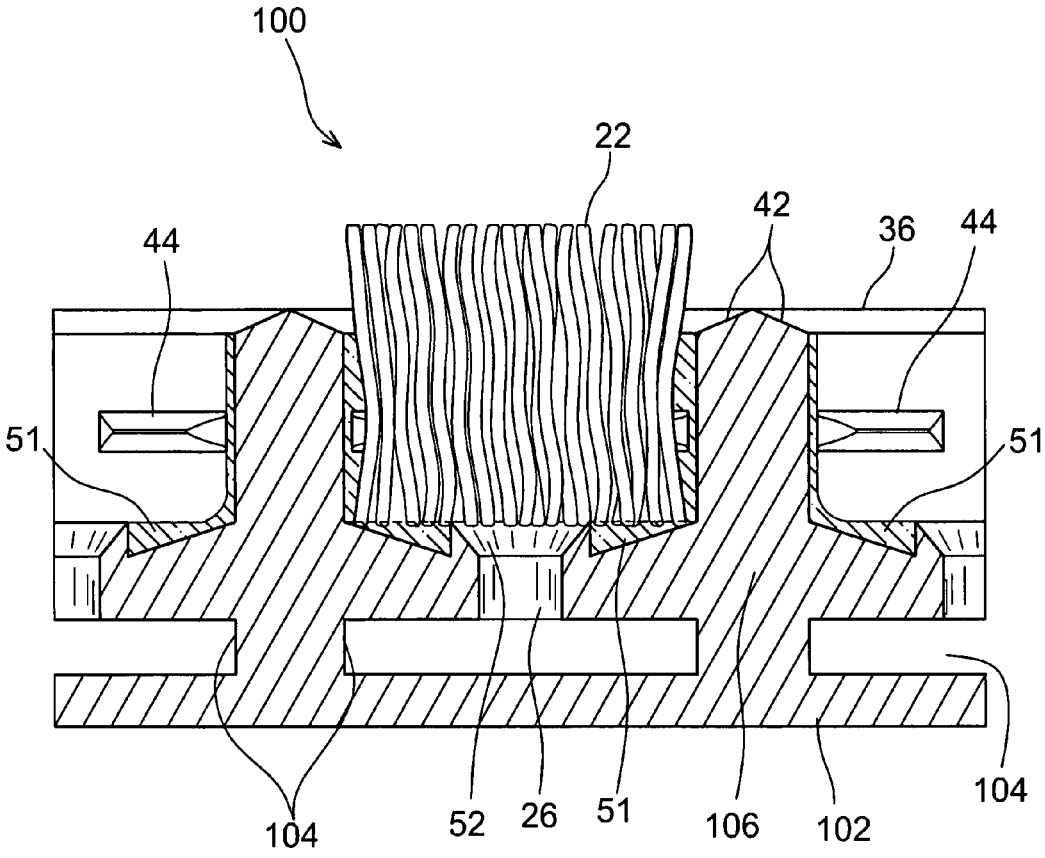
FIG. 4 is an enlarged fragmentary sectional view of a sole member according to a second embodiment with water channels added to the first embodiment of sole attachment.

For the purpose of evenly distributing the fluid of adhesive, each recess 38 has a conical seat 48 and an annual upright wall 50 to form a well for reserving the adhesive converged in the center of recess 38 just before fiber bundle 22 is introduced to start making a permanent bonding session. The temporary adhesive wells are clearly indicated at 51 in FIG. 4 illustrating the coverage of adhesive 51 around recess wall 50 and seat 48. Inwardly of upright wall 50, thru hole 26 is shaped to have a funnel opening 52 to facilitate accepting moisture expelled from squeezing saturated fiber bundles 22 under the walking load of the wearer during operation of the tread 1.

Upon attachment of tread 1 to the shoe 10 slightly protruding fiber bundles 22 collectively work to provide a unique advantage of positive displacement of water to sideways and thus secure grip on a wet floor as well as a familiar traction not different from conventional treads.

Figure 5:
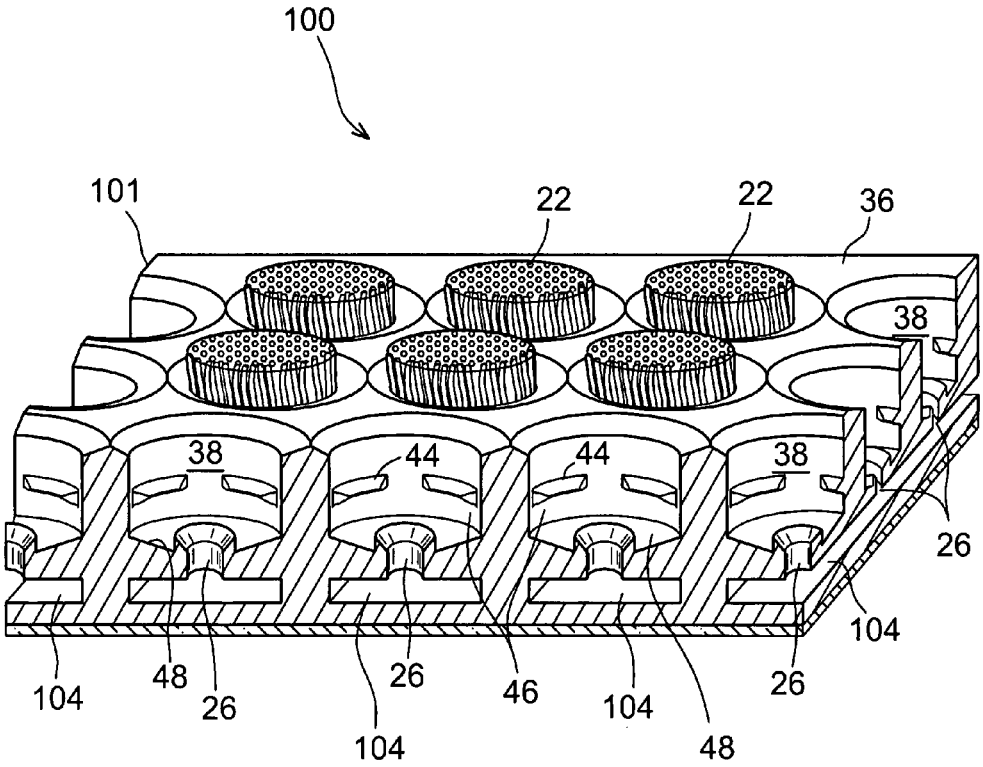
FIG. 5 is a perspective sectional view of a part of the second embodiment of sole member taken along line 5-5 of FIG. 1 clearly showing the water channels and an adhesive layer.

Referring to FIGS. 4 and 5 showing the bottom of side area 34 in section cut lengthwise with respective to widthwise as in FIG. 3, a second embodiment of the sole tread 100 of the present invention is good for both custom attachment to existing shoes and integration into the shoe manufacturing at the sole making and bonding processes. Tread 100 has a base plate 101 with an additional solid top surface 102 that can provide a bonding surface in its entirety in order to provide a better bonding of tread 100 by an end user or in the manufacturing process where the sole 12 may be formed integral to the inventive tread 100.

In order to provide channels for displacing water, tread 100 further includes lateral apertures 104 for communicating holes 26 to side open spaces between sole 12 (FIG. 1) and tread 100. Upon attachment of tread 100 to the shoe 10 slightly protruding fiber bundles 22 collectively work to provide a unique advantage of positive displacement of water to sideways through apertures 104 and thus secure grip on a wet floor. Additionally, closed joined crossbeams 106 are formed in base plate 101 to enhance the supportive strength of tread 100 so that apertures 104 are squeezed under the walking load and return to their shape quickly every time the wearer changes steps on shoe 12 and its other pair. The repetitive depressions applied vertically to tread 100 will create a vacuum in the apertures 104 to draw more moisture absorbed by fibers 22 to expedite the displacement of water resulting in a highly secure grip of shoe 10 even before the wearer becomes aware of the danger of the slippery situation in a concealed manner.

Therefore, while the presently preferred form of the wet-repellent soles and shoes have been shown and described, and several modifications thereof discussed, persons skilled in this art will readily appreciate that various additional changes and modifications may be made without departing from the spirit of the invention, as defined and differentiated by the following claims.

For example, the process of planting fiber bundles 22 into base plate 20, 20*a*, 101 may be achieved by molding wherein a treaded sole is formed integral to the fibers by injecting a liquid soling material around the aligned fiber bundles 22 leaving short protrusions below the bottom surface 36.

The invention claimed is:

1. Moisture repellant slip resistance shoes using wearer's own weight comprising:

a top section for enclosing at least a part of the instep of a foot;

a sole section attached to the top section for supporting the sole of the foot, the sole section having an outsole with traction surfaces facing a floor; and one or more flexible suction pads affixed to bottom surfaces of the sole section, the suction pads having a plurality of small absorbent elements partially planted in the suction pad to contact moisture on the floor and perforations formed through the suction pad for channeling the moisture absorbed by the absorbent elements laterally in response to downward pressures as a wearer walks to have the suction pads maintain a positive grip on the floor as they eliminate a slippery moisture layer between the floor and the shoes.

2. The slip resistance shoes of claim 1, wherein the absorbent elements are short cross cuts of cotton strands.

3. The slip resistance shoes of claim 1, wherein the absorbent elements are short cross cuts of synthetic fibers.

4. The slip resistance shoes of claim 1, wherein the absorbent elements are short cross cuts of a mixture of cotton strands and synthetic fibers.

5. The slip resistance shoes of claim 3, wherein the synthetic fibers are made of rayon.

6. The slip resistance shoes of claim 1, wherein the absorbent elements are in bundles formed into loops by folding a length of strands of fibers into U-shapes.

7. The slip resistance shoes of claim 1, wherein multiple lateral channels are formed in the suction pads in communication with the perforations for channeling moisture laterally.

8. A moisture repellant tread for attachment to an outsole of a shoe comprising:

a base plate having a top surface locally bonded to the outsole with a lateral clearance between the base plate and outsole about the bonded areas, a bottom surface for contacting a floor and multiple closely arranged recesses open to the bottom surface and communicating through smaller openings formed at the top surfaces concentrically of the recesses; and multiple short bundles of absorbent fibers partially implanted in the recesses for displacing water absorbed from the floor upon contact through the openings at the top surfaces to the lateral clearance whereby the tread secures an increased traction as a wearer steps on the tread through the shoe even on a film of moisture.

9. The moisture repellant tread of claim 8, wherein the absorbent fibers are short cross cuts of cotton strands.

10. The moisture repellant tread of claim 8, wherein the absorbent fibers are short cross cuts of synthetic fibers.

11. The moisture repellant tread of claim 8, wherein the absorbent fibers are short cross cuts of a mixture of cotton strands and synthetic fibers.

12. The moisture repellant tread of claim 10, wherein the synthetic fibers are made of rayon.

13. The moisture repellant tread of claim 8, wherein the absorbent fibers are in bundles formed into loops by folding a length of strands of fibers into U-shapes.

14. The moisture repellant tread of claim 8, wherein multiple lateral channels are formed in the base plate in communication with the openings at the top surfaces for channeling moisture laterally.

15. A moisture repellant outsole for a shoe including a top section for enclosing at least a part of the instep of a foot, the outsole comprising:

a traction member facing a floor, a plurality of small absorbent elements partially planted in the traction member to contact moisture on a floor and perforations formed through the traction member for channeling the moisture absorbed by the absorbent elements laterally in response to downward pressures as the wearer walks to have the traction member maintain a dynamic non-slipping grip on the floor, whereby eliminating an injurious moisture layer between the floor and the shoe.

16. The moisture repellant outsole of claim 15, wherein the absorbent elements are short cross cuts of cotton strands.

17. The moisture repellant outsole of claim 15, wherein the absorbent elements are short cross cuts of synthetic fibers.

18. The moisture repellant outsole of claim 15, wherein the absorbent elements are short cross cuts of a mixture of cotton strands and synthetic fibers.

19. The moisture repellant outsole of claim 15, wherein the absorbent elements are in bundles formed into loops by folding a length of strands of fibers into U-shapes.

20. The moisture repellant outsole of claim 15, wherein multiple lateral channels are formed in the traction member in communication with the perforations for channeling moisture laterally.

* * * * *